US008328565B2

(12) United States Patent
Westman et al.

(10) Patent No.: US 8,328,565 B2
(45) Date of Patent: Dec. 11, 2012

(54) TRANSCEIVER ASSEMBLY HAVING AN IMPROVED RECEPTACLE CONNECTOR

(75) Inventors: John Eugene Westman, Harrisburg, PA (US); Brian Keith McMaster, Mechanicsburg, PA (US); Michael Frank Cina, Elizabethtown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 192 days.

(21) Appl. No.: 12/842,688

(22) Filed: Jul. 23, 2010

(65) Prior Publication Data

US 2012/0021654 A1 Jan. 26, 2012

(51) Int. Cl.
*H01R 4/66* (2006.01)

(52) U.S. Cl. ..... 439/108; 439/682

(58) Field of Classification Search ..... 439/32, 439/59, 60, 64, 108, 327–329, 630–637, 439/682

See application file for complete search history.

(56) References Cited

U.S. PATENT DOCUMENTS 6,666,702 B1 * 12/2003 Pickles ..... 439/328
6,749,444 B2 * 6/2004 Murr et al. ..... 439/79
6,893,293 B2 * 5/2005 Ice et al. ..... 439/607.2
6,926,565 B2 * 8/2005 Fogg ..... 439/862
7,025,617 B2 * 4/2006 Regnier et al. ..... 439/329
7,048,567 B2 5/2006 Regnier et al.
7,070,446 B2 7/2006 Henry et al.
7,175,446 B2 2/2007 Bright et al.
7,442,089 B2 10/2008 Regnier
7,458,854 B1 12/2008 Morgan
7,674,133 B2 3/2010 Fogg et al.
7,997,937 B2 * 8/2011 Kondo ..... 439/660

* cited by examiner

*Primary Examiner* — Thanh Tam Le

(57) ABSTRACT

A receptacle connector includes contacts having posts and contact tails extending from the posts. The contact tails are configured to be mounted to a circuit board. The contacts have mating sections extending from the posts. The mating sections are configured for mating with a mating connector. The contacts define signal contacts and ground contacts with the signal contacts arranged in pairs and the pairs of signal contacts being separated by at least one ground contact. The receptacle connector also includes a housing holding the signal and ground contacts in parallel at a predetermined pitch. The housing has a front and a rear with a cavity at the front being configured to receive the mating connector. The housing has walls defining channels that receive the signal and ground contacts. The channels holding the signal contacts have air pockets between the signal contacts such that the amount of air between adjacent signal contacts is greater than the amount of air between signal contacts and adjacent ground contacts.

19 Claims, 9 Drawing Sheets

TRANSCEIVER ASSEMBLY HAVING AN IMPROVED RECEPTACLE CONNECTOR

BACKGROUND OF THE INVENTION

The subject matter herein relates generally to a transceiver assembly, and more particularly, to a receptacle connector for use in a transceiver assembly.

Various types of fiber optic and copper based transceiver assemblies that permit communication between electronic host equipment and external devices are known. These transceiver assemblies typically include a module assembly that can be pluggably connected to a receptacle in the host equipment to provide flexibility in system configuration. The module assemblies are constructed according to various standards for size and compatibility, one standard being the Small Form-factor Pluggable (SFP) module standard. Conventional SFP modules and receptacle assemblies perform satisfactorily carrying data signals at rates up to 2.5 gigabits per second (Gbps). Another pluggable module standard, the XFP standard, calls for the transceiver module to carry data signals at rates up to 10 Gbps.

The pluggable modules are plugged into a transceiver assembly that is mounted on a circuit board within the host equipment. The transceiver assembly includes an elongated guide frame, or cage, having a front that is open to an interior space, and a receptacle connector disposed at a rear of the cage within the interior space. Both the receptacle connector and the guide frame are electrically and mechanically connected to the circuit board, and when the pluggable module is plugged into the transceiver assembly, the pluggable module is electrically and mechanically connected to the circuit board as well.

Receptacle connectors, particularly when designed to operate at high speeds, are designed with tight differential coupling to maintain proper impedances. However, known receptacle connectors have problems maintaining such tight differential coupling and impedances. The receptacle connectors do not provide adequate coupling between signal and ground contacts to meet the requirements. Additionally, known receptacle connectors have problems matching trace couplings with the host circuit board leading to and from the receptacle connector.

It would be desirable to provide a receptacle connector for a transceiver assembly that exhibits good electrical characteristics. It would be desirable to provide a receptacle connector for a transceiver assembly that has improved performance while maintaining an industry standard interface.

BRIEF DESCRIPTION OF THE INVENTION

In one embodiment, a receptacle connector is provided that includes contacts having posts and contact tails extending from the posts. The contact tails are configured to be mounted to a circuit board. The contacts have mating sections extending from the posts that are configured for mating with a mating connector, such as a circuit board of a mating connector. The contacts define signal contacts and ground contacts with the signal contacts arranged in pairs and the pairs of signal contacts being separated by at least one ground contact. The receptacle connector also includes a housing holding the signal and ground contacts in parallel at a predetermined pitch. The housing has a front and a rear with a cavity at the front being configured to receive the mating connector. The housing has walls defining channels that receive the signal and ground contacts. The channels holding the signal contacts have air pockets between the signal contacts such that the amount of air between adjacent signal contacts is greater than the amount of air between signal contacts and adjacent ground contacts.

In another embodiment, a transceiver assembly is provided including a receptacle guide frame configured to be mounted to a host circuit board. The receptacle guide frame has a front that is open to an interior space. The receptacle guide frame is configured to receive a pluggable module through the front. The transceiver assembly also includes a receptacle connector received within the interior space of the receptacle guide frame at a rear of the receptacle guide frame. The receptacle connector includes contacts having posts and contact tails extending from the posts. The contact tails are configured to be mounted to a circuit board. The contacts have mating sections extending from the posts. The mating sections are configured for mating with a mating connector. The contacts define signal contacts and ground contacts with the signal contacts arranged in pairs and the pairs of signal contacts being separated by at least one ground contact. The receptacle connector also includes a housing holding the signal and ground contacts in parallel at a predetermined pitch. The housing has a front and a rear with a cavity at the front being configured to receive the mating connector. The housing has walls defining channels that receive the signal and ground contacts. The channels holding the signal contacts have air pockets between the signal contacts such that the amount of air between adjacent signal contacts is greater than the amount of air between signal contacts and adjacent ground contacts.

In a further embodiment, a receptacle connector is provided including contacts having posts and contacts tails extending from the posts. The contact tails are configured to be mounted to a circuit board. The contacts have mating sections extending from the posts that are configured for mating with a mating connector. The contacts define signal contacts and ground contacts with the signal contacts arranged in pairs and the pairs of signal contacts being separated by at least one ground contact. The receptacle connector also includes a housing holding the signal and ground contacts in parallel at a predetermined pitch. The housing has a front and a rear with a cavity at the front configured to receive the mating connector. The housing has walls defining signal channels that receive the signal contacts and ground channels that receive the ground contacts. The signal channels have a greater volume than the ground channels.

DETAILED DESCRIPTION OF THE INVENTION

Figure 1:
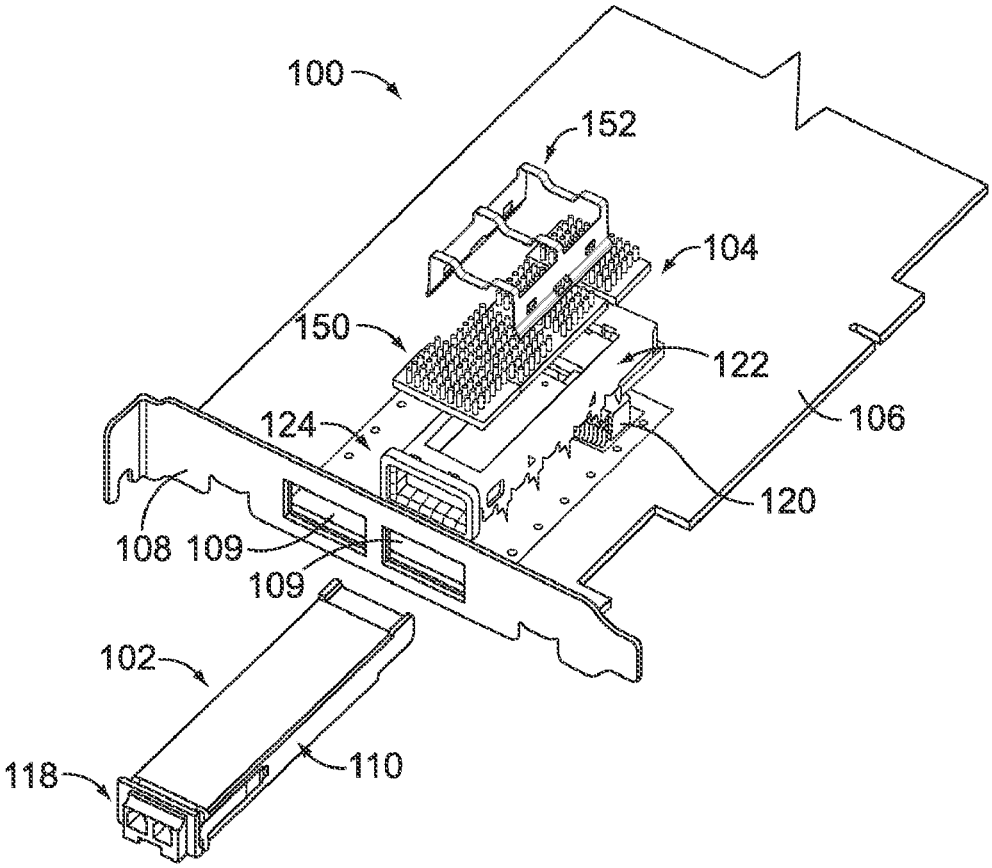
FIG. 1 is an exploded perspective view of a transceiver assembly formed in accordance with an exemplary embodiment.

FIG. 1 illustrates a transceiver assembly 100 adapted to address, among other things, conveying data signals at high rates, such as data transmission rates of 10 gigabits per second (Gbps) required of the XFP standard. It is appreciated, however, that the benefits and advantages of the subject matter described herein may accrue equally to other data transmission rates and across a variety of systems and standards.

As shown in FIG. 1, the assembly 100 generally includes a pluggable module 102 configured for pluggable insertion into a receptacle assembly 104 that is mounted to a host circuit board 106, which, in turn, is mounted in a host system such as a router or computer (not shown). The host system typically includes a conductive chassis having a bezel 108 including openings 109 therethrough in substantial alignment with a respective receptacle assembly 104. The pluggable module 102 is inserted into the receptacle assembly 104 through the bezel opening 109, and the receptacle assembly 104 is electrically connected to the bezel 108.

In the illustrated embodiment, the pluggable module 102 includes a housing 110 that forms a protective shell for a circuit board 112 (shown in FIG. 3) that is disposed within the housing 110. The circuit board 112 carries electronic circuitry and devices that perform transceiver functions in a known manner. An edge 114 (shown in FIG. 3) of the circuit board 112 is exposed through a rear of the housing 110, and the edge 114 is pluggable into the receptacle assembly 104 as described below. Alternatively, a connector may be mounted to the circuit board and exposed through the rear of the housing 110 for plugging into the receptacle assembly 104. The pluggable module 102 is adapted for installation into the receptacle assembly 104 such that a front end 118 of the pluggable module 102 is extended therefrom.

The pluggable module 102 is configured to be inserted into the receptacle assembly 104. In general, the pluggable module 102 and receptacle assembly 104 may be used in any application requiring an interface between a host system and electrical or optical signals. The pluggable module 102 interfaces to the host system through the receptacle assembly 104 via a receptacle connector 120 which is located within a receptacle guide frame 122, also referred to as a cage 122. The pluggable module 102 interfaces to an optical fiber or electrical cable (not shown in FIG. 1) through a connector interface at the front end 118 of the pluggable module 102.

The pluggable module 102 and the receptacle assembly 104 reduce EMI emission through one or more of several EMI reduction features, including the receptacle guide frame 122 and one or more gasket assemblies 124.

The receptacle connector 120 is mounted on the host circuit board 106 of the host equipment separate from the receptacle guide frame 122 and gasket assemblies 124. The receptacle connector 120 includes a slot 224 (shown in FIG. 3) that opens to a cavity 322 (shown in FIG. 3) that receives the edge 114 of the circuit board 112, or a connector mounted to the circuit board 112, that is carried by the pluggable module 102. The receptacle connector 120 receives the pluggable module 102 when the pluggable module 102 is fully installed in the receptacle guide frame 122, thereby electrically connecting the pluggable module 102 to the host equipment.

The receptacle guide frame 122 accommodates an optional heat sink 150. The heat sink 150 is positioned to make physical contact with the pluggable module 102 when the pluggable module 102 is installed into the receptacle assembly 104. A clip 152 is mounted over the heat sink 150 and is secured to the receptacle guide frame 122. The clip 152 ensures that the heat sink 150 is loaded against the pluggable module 102 to facilitate thermal transfer from the pluggable module 102 to the heat sink 150.

Figure 2:
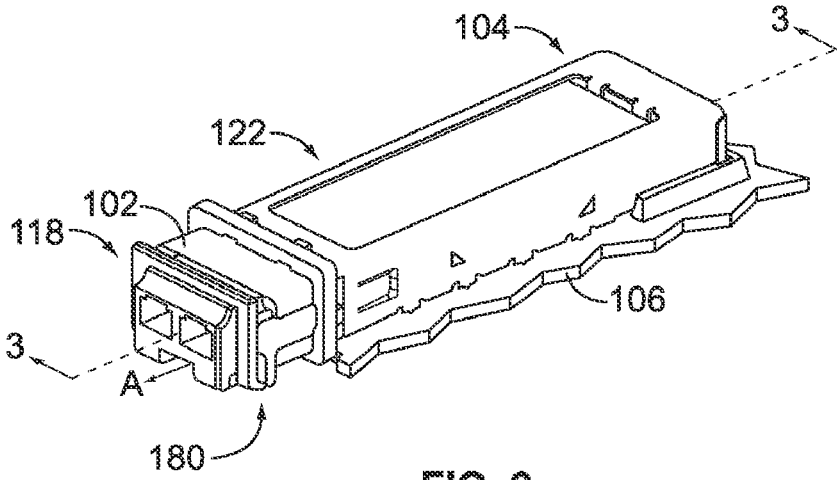
FIG. 2 is an assembled perspective view of a portion of the assembly shown in FIG. 1, showing a pluggable module mated with a receptacle assembly.

FIG. 2 is a perspective view of the receptacle assembly 104 mounted to the host circuit board 106 and receiving the pluggable module 102, with the heat sink 150 and the clip 152 (both shown in FIG. 1) removed for clarity. Also, the bezel 108 is not shown in FIG. 2.

The pluggable module 102 is illustrated in a latched position wherein removal from the receptacle guide frame 122 is prevented. An axial pull on the front end 118 of the pluggable module 102 in the direction of arrow A, when latched, is ineffective to remove the pluggable module 102. An ejector mechanism 180 is provided on the front end 118 of the pluggable module 102 for unlatching the pluggable module 102 for removal from the receptacle guide frame 122.

Figure 3:
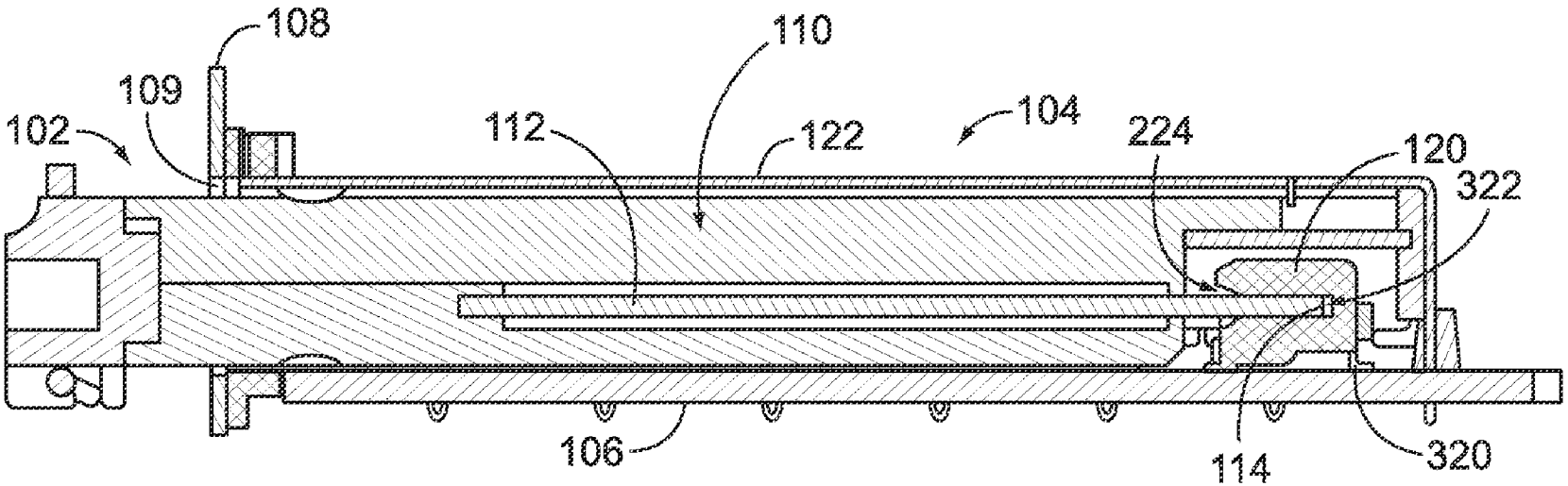
FIG. 3 is a cross sectional view of a portion of the assembly shown in FIG. 1, showing the pluggable module mated with the receptacle assembly.

FIG. 3 is a cross sectional view of the pluggable module 102 coupled to the receptacle assembly 104 with the pluggable module 102 in the latched position. The pluggable module 102 includes the circuit board 112 therein. The edge 114 of the circuit board 112 is received in a connector slot 224 of the receptacle connector 120 which is mechanically and electrically mounted to the host circuit board 106. The receptacle connector 120 includes electrical contacts that contact conductive terminations on the end of the circuit board 112 to establish electrical connection to conductive paths on the host circuit board 106. When the pluggable module 102 is inserted into the receptacle guide frame 122, the edge 114 of the circuit board 112 is inserted into the connector slot 224, and when the pluggable module 102 is fully inserted into the receptacle guide frame 122, the pluggable module 102 is locked in the latched position with the circuit board 112 fully engaged to the receptacle connector 120.

Figure 4:
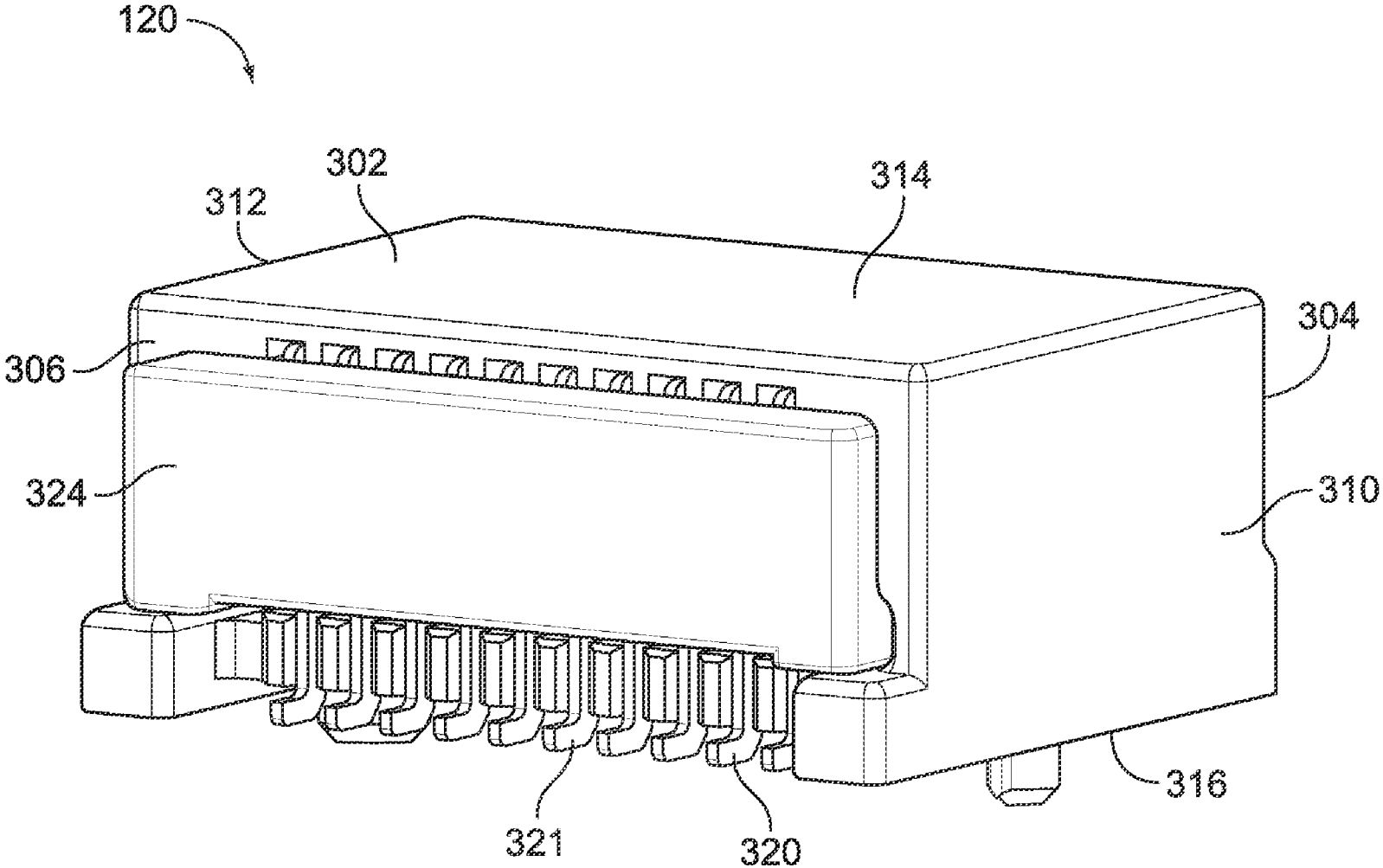
FIG. 4 is a rear perspective view of a receptacle connector for a receptacle assembly and formed in accordance with an exemplary embodiment.

FIG. 4 is a rear perspective view of the receptacle connector 120 for the receptacle assembly 104 (shown in FIG. 1). The receptacle connector 120 includes a housing 302 having a front 304 and a rear 306. The receptacle connector 120 is configured to mate with a mating connector, such as the pluggable module 102 (shown in FIG. 1), at the front 304. For example, the circuit board 112 (shown in FIG. 3) may be received in the connector slot 224 (shown in FIG. 3) open at the front 304. The housing 302 includes opposed sides 310, 312 and a top 314 generally opposite a bottom 316. The bottom 316 is configured to be mounted to a circuit board, such as the host circuit board 106.

The receptacle connector 120 includes a plurality of signal contacts 320, and a plurality of ground contacts 321, which may be collectively referred to as the contacts 320, 321, which are loaded into the cavity 322 (shown in FIG. 3) of the housing 302. Other types of contacts, such as power contacts, may be provided in alternative embodiments. The contacts 320, 321 are loaded through the rear 306 of the housing 302. The receptacle connector 120 also includes a stuffer bar 324 separately provided from the housing 302 and securely coupled to the housing 302, such as at the rear 306. The stuffer bar 324 engages the contacts 320, 321 to hold the contacts 320, 321 within the housing 302. For example, the stuffer bar 324 resists rearward movement of the contacts 320, 321 out of the cavity 322 and/or the stuffer bar 324 resists upward movement of the contacts 320, 321 away from the host circuit board 106. Other types of securing means or features may be used to secure the contacts 320, 321 in the housing 302 other than the stuffer bar 324 in alternative embodiments.

Figure 5:
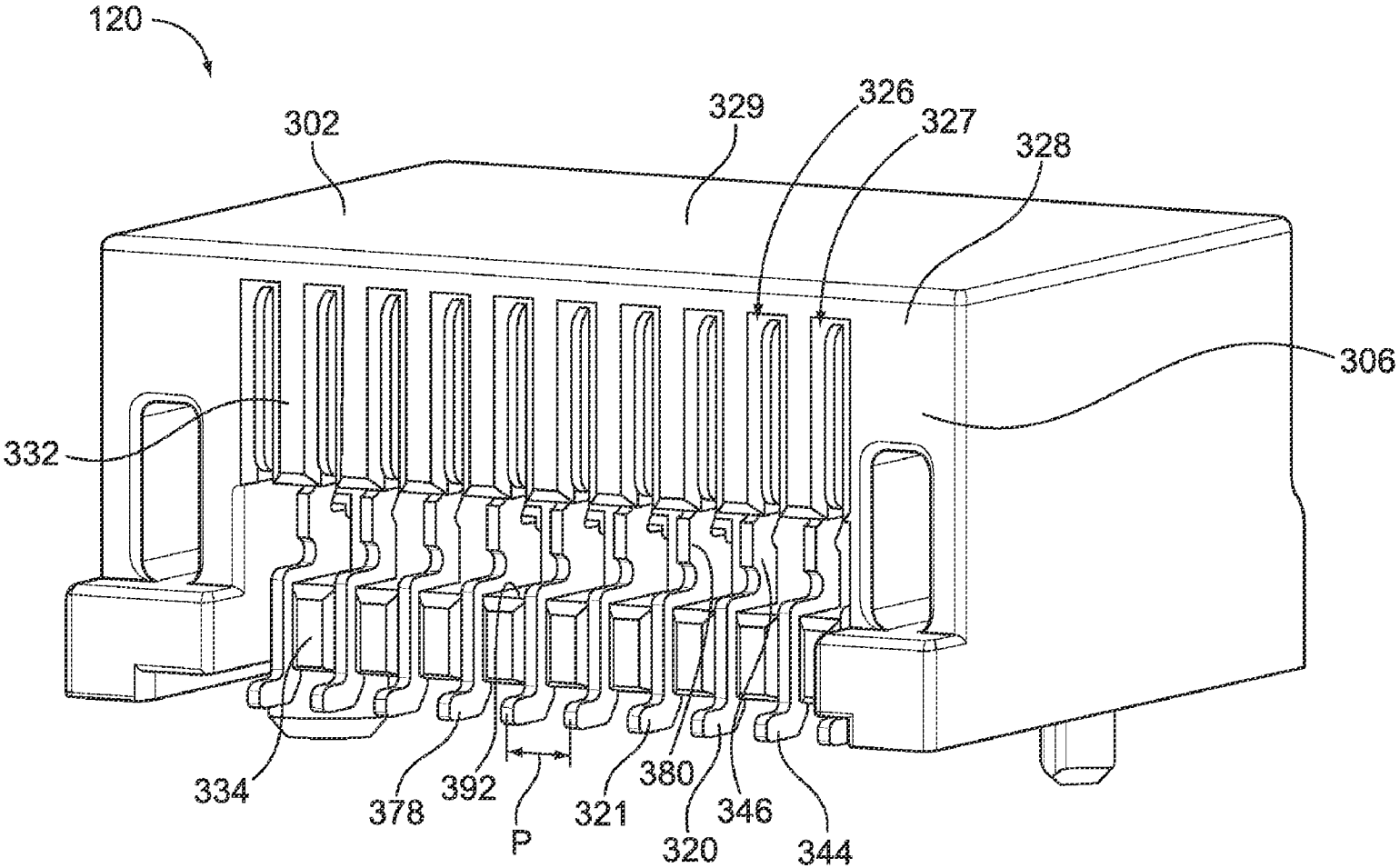
FIG. 5 is a rear perspective view of a portion of the receptacle connector shown in FIG. 4.
Figure 6:
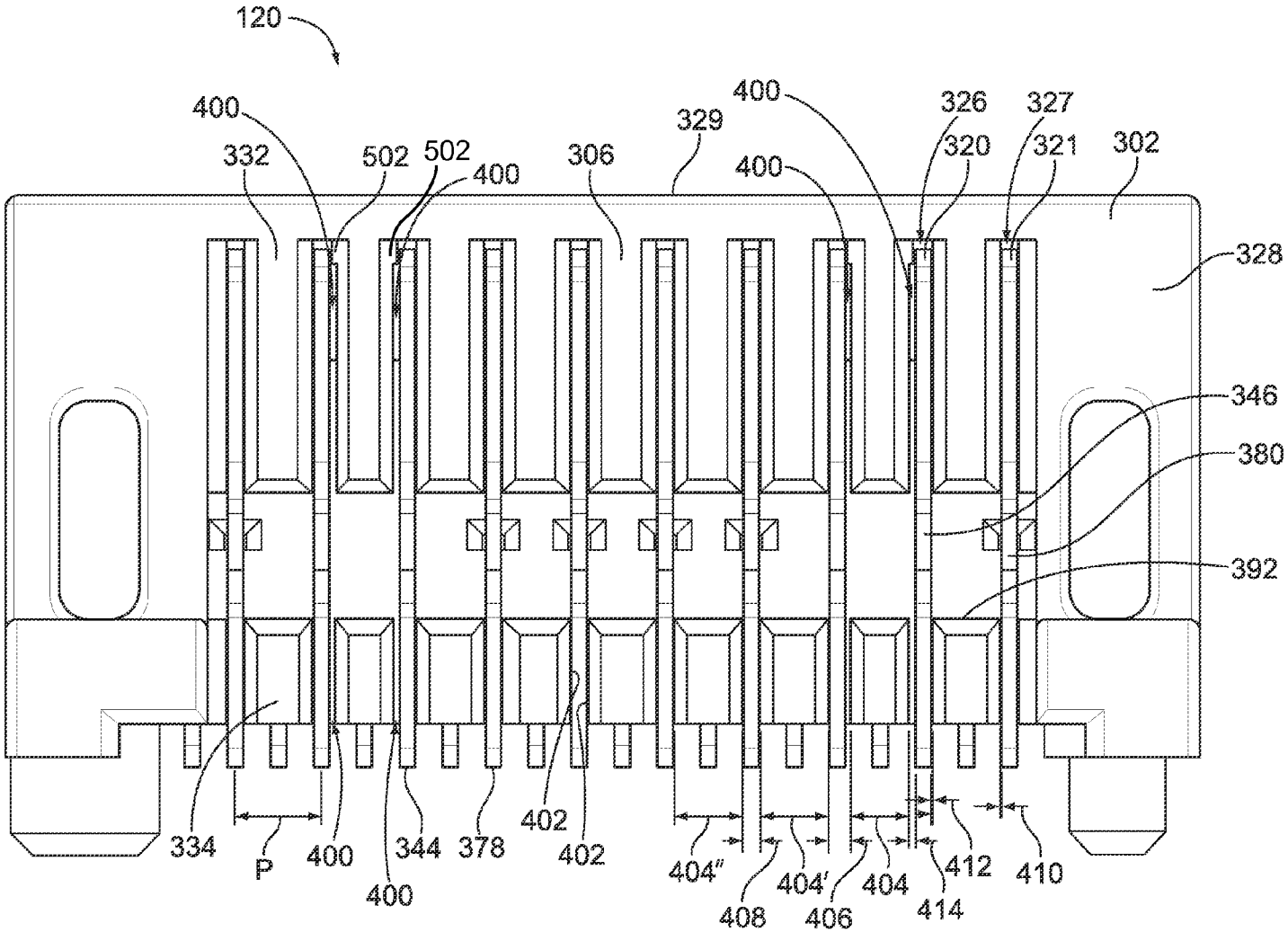
FIG. 6 is a rear view of the receptacle connector shown in FIG. 4.

FIG. 5 is a rear perspective view of a portion of the receptacle connector 120 with the stuffer bar 324 (shown in FIG. 4) removed for clarity. FIG. 6 is a rear view of the receptacle connector 120. In an exemplary embodiment, the housing 302 includes a plurality of signal channels 326 and ground channels 327, which may be collectively referred to as the channels 326, 327. The channels 326, 327 are formed in a rear wall 328 and an upper wall 329 of the housing 302. The signal channels 326 receive corresponding signal contacts 320 therein and the ground channels 327 receive corresponding ground contacts 321 therein. The channels 326, 327 help hold the contacts 320, 321 in position relative to one another (e.g. side-to-side position). The signal channels 326 are sized differently than the ground channels 327, as described in further detail below. The signal channels 326 have air pockets that selectively introduce more air around the signal contacts 320 than the ground contacts 321.

At the rear wall 328, the channels 326, 327 are generally formed by rear wall portions 332, 334 positioned between the contacts 320, 321. The rear wall portions 332, 334 of the housing 302 are formed from a dielectric material. Electrical characteristics of the contacts 320, 321 are controlled by selecting a particular type of dielectric material for the rear wall portions 332, 334. Electrical characteristics of the contacts 320, 321 are controlled by controlling the height and thickness of the rear wall portions 332, 334 between the contacts 320, 321. Electrical characteristics of the contacts 320, 321 are controlled by introducing air pockets into the rear wall portions 332, 334. Between the rear wall portions 332, 334, the contacts 320, 321 are separated from one another by air, which has a different dielectric constant than the rear wall portions 332, 334, and thus affects the electrical characteristics of the contacts 320, 321 differently then the rear wall portions 332, 334.

In an exemplary embodiment, the signal contacts 320 may be arranged in pairs with each signal contact 320 within a pair carrying a differential signal, thus defining differential pairs. In the illustrated embodiment, two pairs of signal contacts 320 are provided, however any number of pairs of signal contacts 320 may be provided in alternative embodiments. The pairs of signal contacts 320 are separated by at least one ground contact 321. In the illustrated embodiment, the pairs of signal contacts are separated by four ground contacts 321, however any number of ground contacts 321 may be provided between the pairs of signal contacts 320. Ground contacts 321 are also provided outside of the pairs of signal contacts 320 (e.g. flanking the pairs of signal contacts 320). In the illustrated embodiment, one ground contact 321 is provided outside of each pair of signal contacts 320, however any number of ground contacts 321 may be provided outside the signal contacts 320. Different numbers of ground contacts 321 may be provided outside each pair of signal contacts 320.

In an exemplary embodiment, the housing 302 holds the contacts 320, 321 in parallel at a predetermined pitch P. The pitch P is the same between signal contacts 320 as between ground contacts 321, which is also the same as the pitch between adjacent signal and ground contacts 320, 321. The SIP standard provides that the contacts 320, 321 have the same pitch. However, different pitches are possible in alternative embodiments.

Figure 7:
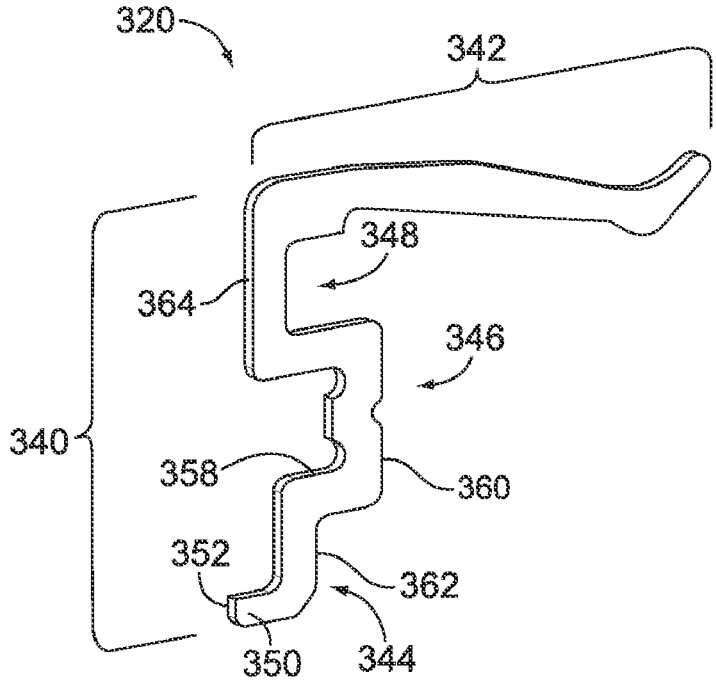
FIG. 7 is a perspective view of a signal contact for the receptacle connector shown in FIG. 4.

FIG. 7 is a perspective view of one of the signal contacts 320. The signal contact 320 includes a post 340 and a mating section 342 that extends generally perpendicular from the post 340. For example, the post 340 is oriented generally vertical (e.g. along the rear 306 of the housing 302 (shown in FIG. 5)) and the mating section 342 is oriented generally horizontal (e.g. along the upper wall 329 of the housing 302 (shown in FIG. 5)). In an exemplary embodiment, each signal contact 320 includes a contact tail 344 configured to be mounted to the host circuit board 106 (shown in FIG. 1). Optionally, the contact tail 344 may be curved or angled such that a mounting portion of the contact tail 344 is generally perpendicular with respect to the post 340 and is oriented for surface mounting to the host circuit board 106, such as by soldering. Alternatively, the contact tail 344 may be a pin, such as a compliant pin, for through-hole mounting to the host circuit board 106.

In an exemplary embodiment, the post 340 includes a retention section 346 with an open side and an upper post section 348 between the retention section 346 and the mating section 342. The retention section 346 is configured to receive the stuffer bar 324 (shown in FIG. 4).

The signal contact 320 includes a first side 350 and a second side 352 opposite the first side 350. When arranged within the housing 302, the first side 350 of one signal contact 320 faces the second side 352 of an adjacent signal contact 320. The first or second side 350, 352 may face an adjacent ground contact 321, depending on the position of the signal contact 320 within the housing 302.

The post 340 includes a front 362 and a rear 364 opposite the front 362. The mating section 342 extends forward from the front 362. The open side of the retention section 346 is provided along the rear 364 of the post 340. The contact tail 344 extends rearward from the rear 364.

Figure 8:
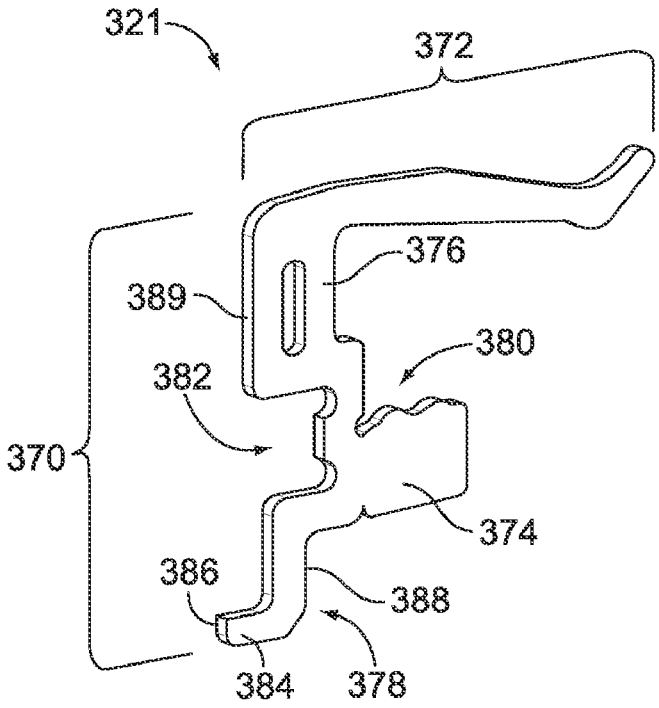
FIG. 8 is a perspective view of a ground contact for the receptacle connector shown in FIG. 4.

FIG. 8 is a perspective view of one of the ground contacts 321. Each ground contact 321 includes a post 370 and a mating section 372 that extends generally perpendicular from the post 370. The ground contact 321 may be similar to the signal contact 320, however the ground contact 321 includes a retention barb 374 and an inner post 376. The retention barb 374 is received in the housing 302 (shown in FIG. 5) and holds the ground contact 321 in the housing 302, such as by a friction fit. The retention barb 374 and inner post 376 provide a greater footprint than that of the signal contact 320, which may help to reduce crosstalk between the pairs of signal contacts 320.

In an exemplary embodiment, both the signal and ground contacts 320, 321 may be stamped from a common stamp. When the retention barb 374 and the inner post 376 are removed, such as during a second stamping process, the contact has the form of a signal contact 320 rather than a ground contact 321. When the retention barb 374 and the inner post 376 remain, the contact has the form of a ground contact 321. Alternatively, the stamps may be different for the signal and ground contacts 320, 321 during an initial stamping process to define the contact as either a signal contact 320 or a ground contact 321.

The post 370 includes a contact tail 378 similar to the contact tail 344 (shown in FIG. 6). The post 370 also includes a retention section 380 configured to receive the sniffer bar 324 (shown in FIG. 4). The retention section 380 may be U-shaped and may define a channel 382 that receives the stuffer bar 324.

The ground contact 321 includes a first side 384 and a second side 386 opposite the first side 384. When arranged within the housing 302, the first side 384 of one ground contact 321 faces the second side 386 of an adjacent ground contact 321. The first or second side 384, 386 may face an adjacent signal contact 320, depending on the position of the ground contact 321 within the housing 302.

The post 370 includes a front 388 and a rear 389 opposite the front 388. The mating section 372 extends forward from the front 388. The open side of the retention section 380 is provided along the rear 389 of the post 370. The contact tail 378 extends rearward from the rear 389.

Returning to FIGS. 5 and 6, the signal and ground contacts 320, 321 are received in the housing 302 through the rear 306. The signal and ground contacts 320, 321 are aligned with one another such that the contact tails 344, 378 are aligned with one another for mounting to the host circuit board 106 (shown in FIG. 1). Similarly, the retention sections 346, 380 are aligned with one another for receiving the stuffier bar 324. In an exemplary embodiment, the housing 302 includes a shelf 392 that faces upward. The retention sections 346, 380 rest on the shelf 392. Optionally, the stuffer bar 324 may hold the retention sections 346, 380 against the shelf 392. The contact tails 344, 378 are then each aligned in proper position with respect to the housing 302. The contact tails 344, 378 are held coplanar with one another for mounting to the host circuit board 106.

As illustrated in FIG. 6, in an exemplary embodiment, the housing 302 includes a plurality of air pockets 400 selectively positioned along the signal contacts 320. In an exemplary embodiment, the air pockets 400 are positioned between the adjacent signal contacts 320 within each pair of signal contacts 320. The air pockets 400 are positioned along the sides of the signal contacts 320 that face one another. The air pockets 400 introduce a greater volume of air between the signal contacts 320 of each pair as compared to a housing that does not include such air pockets 400. Having a greater volume of air between the signal contacts 320 reduces the coupling between the signal contacts 320, which may affect the impedance of the signal pair, such as by lowering the common impedance of the signal pair. In an exemplary embodiment, the air pockets 400 are only positioned on the inner side of the signal contacts 320 within each pair. As such, the amount of air between adjacent signal contacts 320 is greater than the amount of air between signal contacts 320 and adjacent ground contacts 321.

The wall portions 332, 334 defining the rear wall 328 have opposite wall surfaces 402. The distance between the wall surfaces 402 defines a thickness 404 of the wall portions 332, 334. Optionally, the thickness 404 of the wall portion 332 is the same as the thickness 404 of the wall portion 334. Alternatively, the thicknesses 404 of the wall portions 332, 334 may be different. In an exemplary embodiment, the thickness 404 of the wall portions 332, 334 between adjacent signal contacts 320 is thinner than thicknesses 404' of the wall portions 332, 334 between the signal contacts 320 and adjacent ground contacts 321. Similarly, the thickness 404 between the adjacent signal contacts 320 within each pair is thinner than a thickness 404" of the wall portions 332, 334 between adjacent ground contacts 321. In an exemplary embodiment, the air pockets 400 account for the reduced thickness 404 of the wall portions 332, 334 between the signal contacts 320 within each pair.

The wall surfaces 402 of the signal channels 326 are spaced apart by a first average distance 406, which is the average distance separating the wall surfaces 402 along the height of the signal channels 326. The wall surfaces 402 of the ground channels 327 are spaced apart by a second average distance 408. The first average distance 406 is greater than the second average distance 408.

The signal contacts 320 are loaded into the signal channels 326 such that the signal contacts 320 are offset with respect to a center line of the signal channels 326. The ground contacts 321 are loaded into the ground channels 327 such that the ground contacts 321 are substantially centered along a center line of the ground channels 327.

The contacts 320, 321 are loaded into the corresponding channels 326, 327 such that the sides 350, 352, 384, 386 (shown in FIGS. 7 and 8) face the corresponding wall surfaces 402. Both sides 384, 386 of the ground contacts 321 are spaced apart from the corresponding wall surfaces 402 by substantially equal distances 410. The sides 350, 352 of the signal contacts 320 are spaced apart from the corresponding wall surfaces 402 by different distances. For example, the side 350 or 352 of each signal contact 320 facing the adjacent ground contact 321 is spaced apart from the corresponding wall surface 402 by a first distance 412. The side of each signal contact 320 facing the adjacent signal contact 320 within the pair is spaced apart from the corresponding wall surface 402 by a second distance 414 greater than the first distance 412. The air pockets 400 add to the second distance 414 which makes the second distance 414 greater than the first distance 412. Optionally, the first distance 412 may be substantially equal to the distance 410 between the sides 384, 386 of the ground contact 321 and the corresponding wall surfaces 402 of the ground channel 327. Optionally, the distance 410 and the first distance 412 may be substantially zero such that the signal and ground contacts 320, 321 engage, or almost engage, the wall surfaces 402 to position the contacts 320, 321 within the corresponding channels 326, 327.

Figure 9:
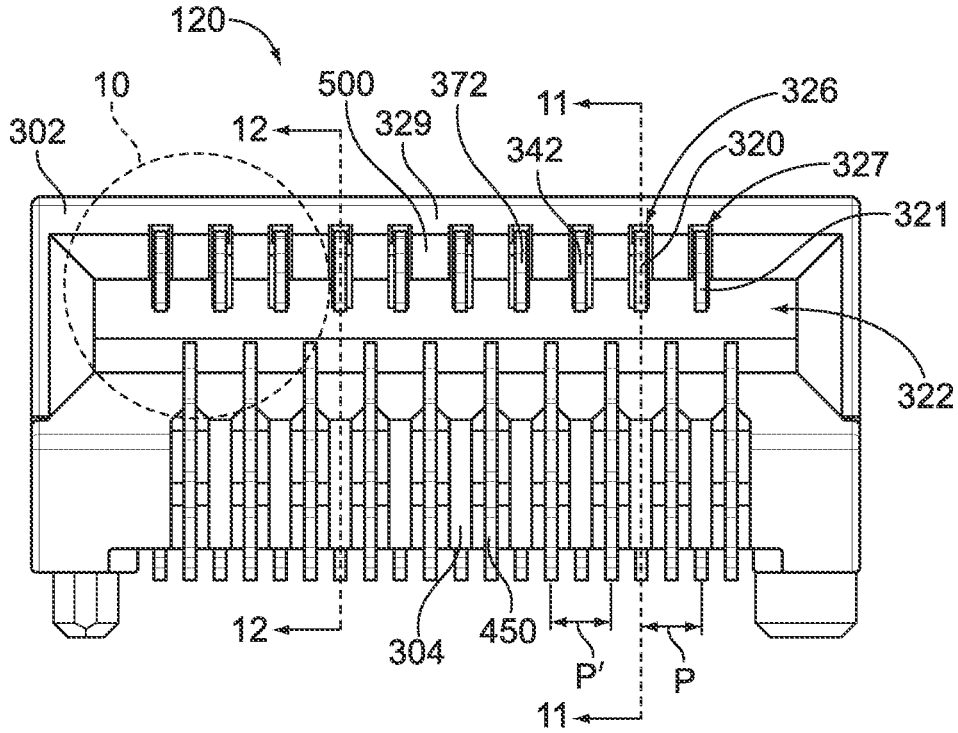
FIG. 9 is a front view of the receptacle connector shown in FIG. 4.
Figure 10:
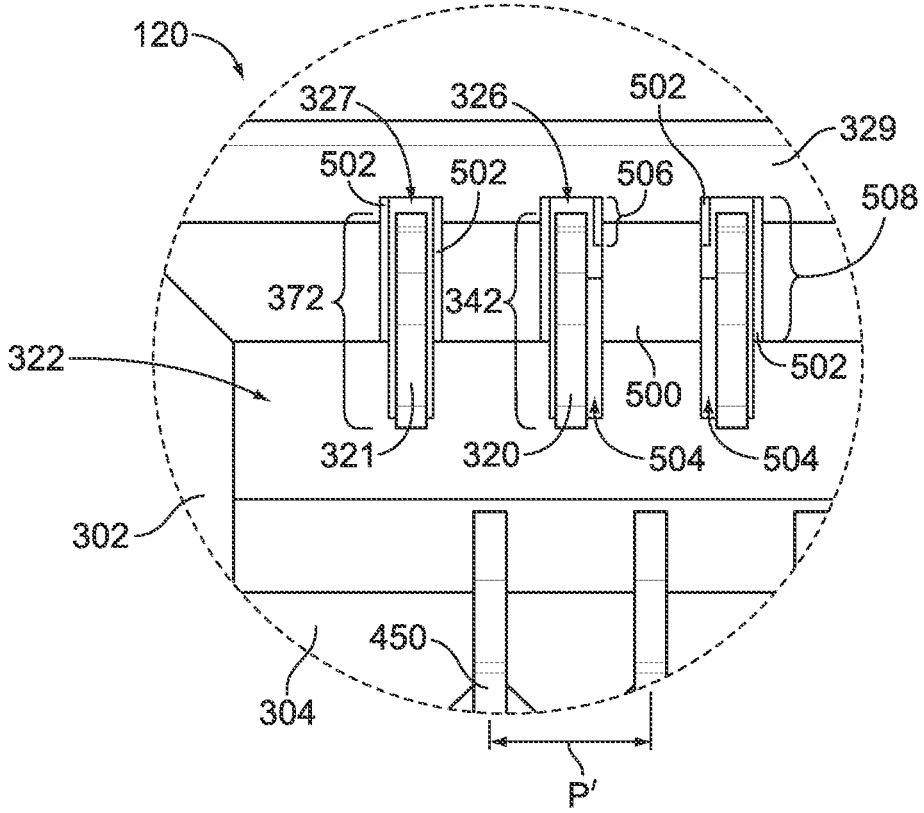
FIG. 10 is an enlarged view of a portion of the receptacle connector shown in FIG. 9.

FIG. 9 is a front view of the receptacle connector 120. FIG. 10 is an enlarged view of a portion of the receptacle connector 120. The cavity 322 is open at the front of the receptacle connector 120. The contacts 320, 321 are held within the housing 302 such that the mating sections 342, 372 of the signal and ground contacts 320, 321, respectively, are exposed within the cavity 322 for mating with the mating connector, such as the pluggable module 102 (shown in FIGS. 1-3).

In an exemplary embodiment, the receptacle connector 120 includes a plurality of lower contacts 450 arranged in a lower row, which are electrically connected to the host circuit board 106 (shown in FIG. 1). The lower contacts 450 are loaded into the housing 302 through the front 304 of the housing 302. In an alternative embodiment, the lower contacts 450 may be loaded into the housing 302 through the rear 306 (shown in FIGS. 5 and 6) in a similar manner as the signal and ground contacts 320, 321. The lower contacts 450 may constitute signal or power contact depending on a particular application. The lower contacts 450 may include signal contacts arranged in differential pairs. The lower contacts 450 are arranged along the lower portion of the cavity 322 and are configured to engage corresponding pads or conductors on the bottom of the pluggable module 102.

The contacts 320, 321 are arranged along the upper portion of the cavity 322, such as along the upper wall 329 and are configured to engage the top surface of the circuit board 112 of the pluggable module 102. In an exemplary embodiment, the lower contacts 450 are spaced apart from one another by a predetermined pitch P'. Optionally, the pitch P' may be equal to the pitch P separating the contacts 320, 321. Optionally, the lower contacts 450 may be offset or staggered with respect to the upper contacts 320, 321. Alternatively, the lower contacts 450 may be aligned directly below the upper contacts 320, 321.

At the upper wall 329, the channels 326, 327 are generally formed by upper wall portions 500 positioned between the contacts 320, 321. The upper wall portions 500 include shoulders 502 (also shown in FIG. 6) extending into the channels 326, 327. The shoulders 502 reduce the size of the channels 326, 327. The shoulders 502 extend into the channels 326, 327 from the upper wall portions 500 to reduce the width of the channels 326, 327 to properly position the contacts 320, 321 within the channels 326, 327. Optionally, the contacts 320, 321 may engage the shoulders 502, which control the lateral position of the contacts 320, 321 within the channels 326, 327.

In an exemplary embodiment, selected portions of the shoulders 502 may have a reduced footprint or be removed all together. For example, the shoulders 502 extending into the signal channels 326 may be removed to form air pockets 504 between the mating sections of the signal contacts 320 within a pair. The pockets 504 are positioned forward of the pockets 400 (shown in FIG. 6). The shoulders 502 separate the pockets 504 from the pockets 400. Optionally, portions of the pockets 504 may open to the pockets 400. In the illustrated embodiment, a bottom portion of the shoulders 502 along the interior sides of the signal contacts 320 within the pair have been shortened such that the shoulders 502 have a height 506 that is substantially less than a height 508 of other shoulders 502, such as the shoulders 502 in the ground channels 327 and/or the shoulders 502 on the outer sides of the signal contacts 320 within each pair. Optionally, the height 506 may be less than the height 508. In alternative embodiment, the height 506 may be zero such that no shoulder is provided along the upper wall portion 500 between the adjacent signal contacts 320.

Figure 11:
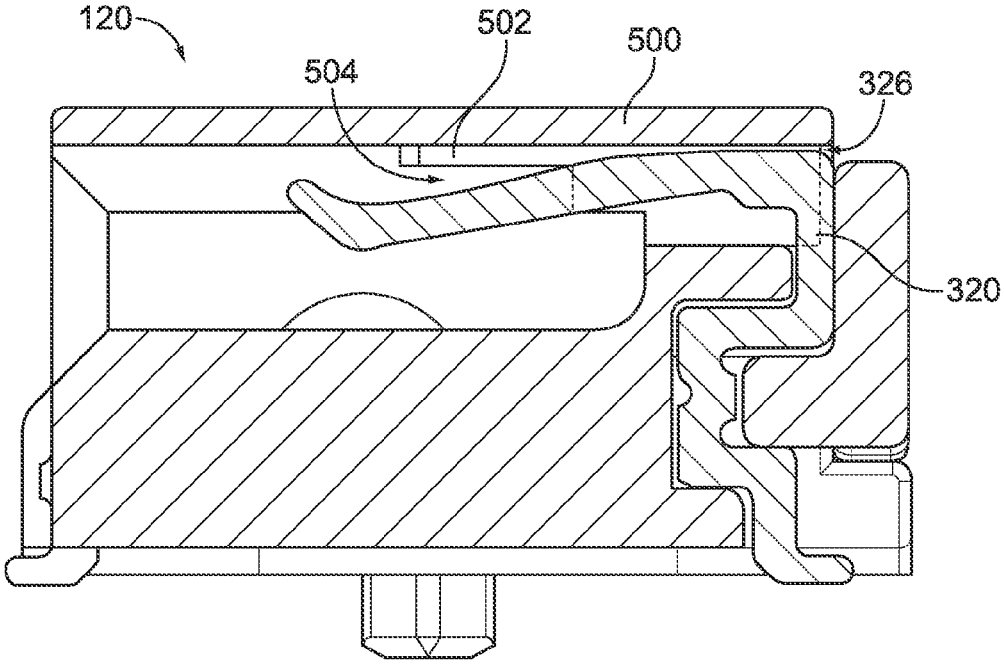
FIG. 11 is a cross-section view of a portion of the receptacle connector taken along line 11-11 in FIG. 9.
Figure 12:
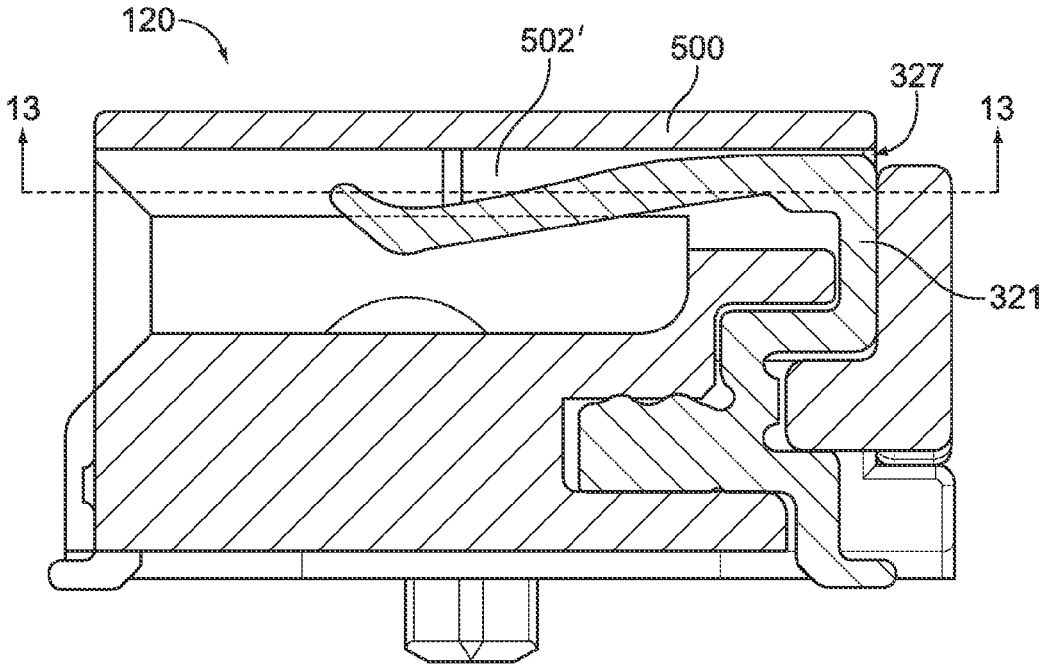
FIG. 12 is a cross-sectional view of a portion of the receptacle connector taken along line 12-12 in FIG. 9.

FIG. 11 is a cross-sectional view of a portion of the receptacle connector 120 taken along line 11-11 shown in FIG. 9. FIG. 12 is a cross-sectional view of a portion of the receptacle connector 120 taken along line 12-12 shown in FIG. 9. The cross-section shown in FIG. 11 is taken along one of the signal contacts 320. The cross-section shown in FIG. 12 is taken along one of the ground contacts 321.

Both figures illustrate the upper wall portions 500 and show the shoulders 502 extending inward from the corresponding upper wall portion 500. The shoulder 502 within the signal channel 326 has been at least partially removed as compared to the shoulder 502' within the ground channel 327. Removal of such shoulder 502 creates the air pocket 504, thus creating a larger volume of air between adjacent signal contacts 320.

Figure 13:
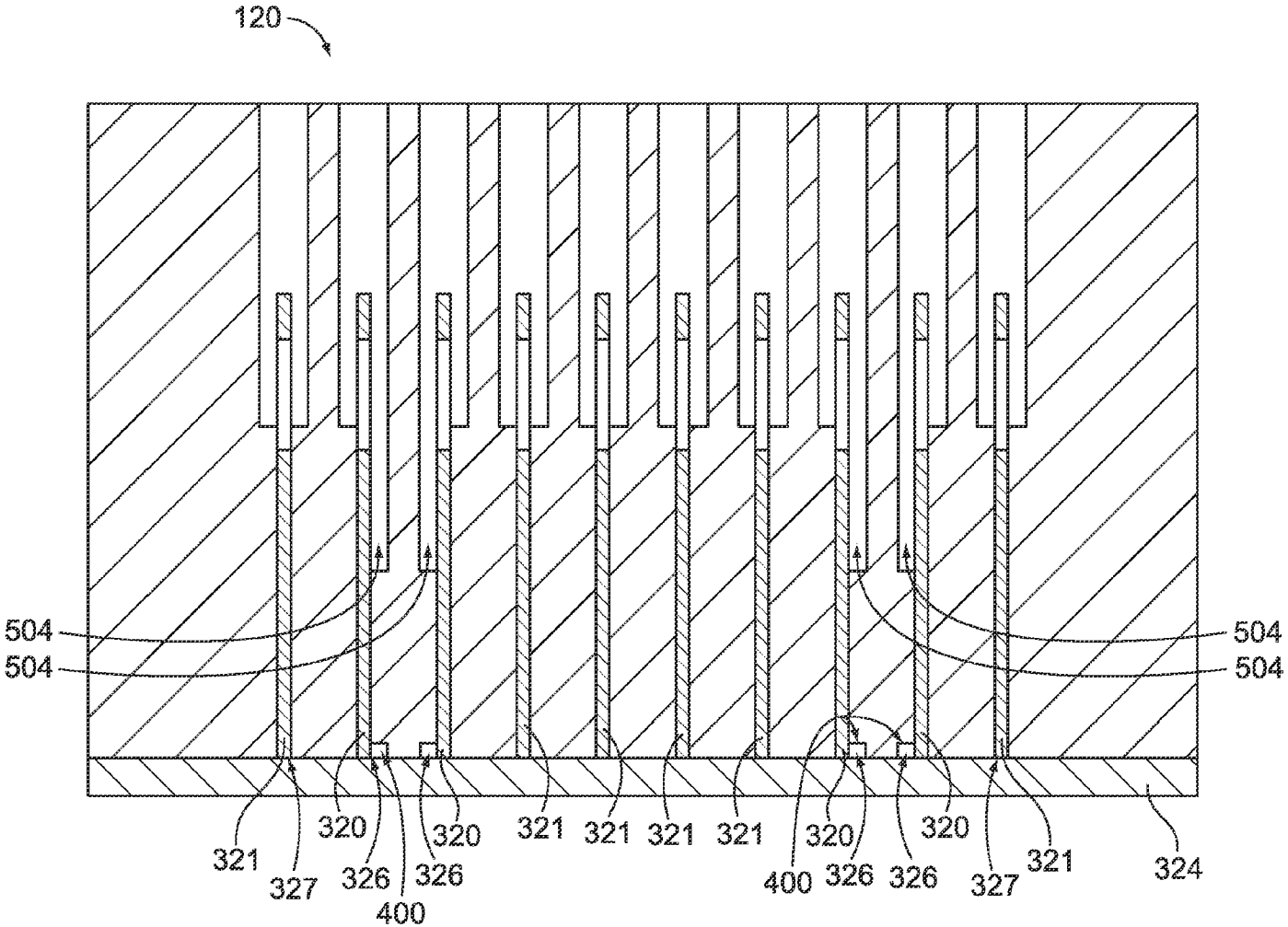
FIG. 13 is a cross-sectional view of a portion of the receptacle connector taken along line 13-13 in FIG. 12.

FIG. 13 is a cross-sectional view of a portion of the receptacle connector 120 taken along line 13-13 in FIG. 12. The signal and ground channels 326, 327 are illustrated with the signal and ground contacts 320, 321, received therein. FIG. 13 illustrates the shoulders 502 extending inward from the upper wall portions 500, as well as the air pockets 504 positioned between the signal contacts 320 of each pair. FIG. 13 also illustrates the air pockets 400 between the signal contacts 320 within each pair.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention, should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A receptacle connector comprising:

contacts having posts and contact tails extending from the posts, the contact tails being configured to be mounted to a circuit board, the contacts having mating sections extending from the posts, the mating sections being configured for mating with a mating connector, the contacts defining signal contacts and ground contacts with the signal contacts arranged in pairs, the pairs of signal contacts being separated by at least one ground contact; and a housing holding the signal and ground contacts in parallel at a predetermined pitch, the housing having a front and a rear with a cavity at the front being configured to receive the mating connector, the housing having walls defining channels that receive the signal and ground contacts, the channels holding the signal contacts having air pockets between the signal contacts such that the amount of air between adjacent signal contacts is greater than the amount of air between signal contacts and adjacent ground contacts, the air pockets being located directly between the signal contacts and the walls defining the channels.

2. The receptacle connector of claim 1, wherein the walls are thicker between the signal contacts and adjacent ground contacts, and wherein the walls are thinner between the adjacent signal contacts within the pair.

3. The receptacle connector of claim 1, wherein the channels have wall surfaces, the wall surfaces of the channels holding signal contacts being spaced apart by a first average distance, the wall surfaces of the channels holding ground contacts being spaced apart by a second average distance, the first average distance being greater than the second average distance.

4. The receptacle connector of claim 1, wherein the channels have wall surfaces, the contacts having opposed sides, the contacts being loaded into the channels such that the sides face the wall surfaces, the sides of the ground contacts being spaced apart from the corresponding wall surfaces by substantially equal distances, the sides of the signal contacts being spaced apart from the corresponding wall surfaces by different distances.

5. The receptacle connector of claim 1, wherein the channels have wall surfaces, the contacts having opposed sides, the contacts being loaded into the channels such that the sides face the wall surfaces, the sides of the ground contacts being spaced apart from the corresponding wall surfaces by substantially equal distances, the side of each signal contact facing the adjacent ground contact being spaced apart from the corresponding wall surface by a first distance, the side of each signal contact facing the adjacent signal contact being spaced apart from the corresponding wall surface by a second distance greater than the first distance.

6. The receptacle connector of claim 1, wherein the contacts are stitched into the housing.

7. The receptacle connector of claim 1, wherein the contacts define upper contacts with the mating sections being arranged along an upper wall of the housing, the receptacle connector further comprising lower contacts being arranged along a lower wall of the housing, the upper contacts being loaded into the housing through the rear of the housing, the lower contacts being loaded into the housing through the front of the housing.

8. A transceiver assembly comprising:

a receptacle guide frame configured to be mounted to a host circuit board, the receptacle guide frame having a front being open to an interior space, the receptacle guide frame being configured to receive a pluggable module through the front; and a receptacle connector received within the interior space of the receptacle guide frame at a rear of the receptacle guide frame, the receptacle connector comprising:

contacts having posts and contact tails extending from the posts, the contact tails being configured to be mounted to a circuit board, the contacts having mating sections extending from the posts, the mating sections being configured for mating with a mating connector, the contacts defining signal contacts and ground contacts with the signal contacts arranged in pairs, the pairs of signal contacts being separated by at least one ground contact; and a housing holding the signal and ground contacts in parallel at a predetermined pitch, the housing having a front and a rear with a cavity at the front being configured to receive the mating connector, the housing having walls defining channels that receive the signal and ground contacts, the channels holding the signal contacts having air pockets between the signal contacts such that the amount of air between adjacent signal contacts is greater than the amount of air between signal contacts and adjacent ground contacts, the air pockets being located directly between the signal contacts and the walls defining the channels.

9. The transceiver assembly of claim 8, wherein the walls are thicker between the signal contacts and adjacent ground contacts, and wherein the walls are thinner between the adjacent signal contacts within the pair.

10. The transceiver assembly of claim 8, wherein the channels have wall surfaces, the wall surfaces of the channels holding signal contacts being spaced apart by a first average distance, the wall surfaces of the channels holding ground contacts being spaced apart by a second average distance, the first average distance being greater than the second average distance.

11. The transceiver assembly of claim 8, wherein the channels have wall surfaces, the contacts having opposed sides, the contacts being loaded into the channels such that the sides face the wall surfaces, the sides of the ground contacts being spaced apart from the corresponding wall surfaces by substantially equal distances, the sides of the signal contacts being spaced apart from the corresponding wall surfaces by different distances.

12. The transceiver assembly of claim 8, wherein the channels have wall surfaces, the contacts having opposed sides, the contacts being loaded into the channels such that the sides face the wall surfaces, the sides of the ground contacts being spaced apart from the corresponding wall surfaces by substantially equal distances, the side of each signal contact facing the adjacent ground contact being spaced apart from the corresponding wall surface by a first distance, the side of each signal contact facing the adjacent signal contact being spaced apart from the corresponding wall surface by a second distance greater than the first distance.

13. The transceiver assembly of claim 8, wherein the contacts are stitched into the housing.

14. A receptacle connector comprising:

contacts having posts and contact tails extending from the posts, the contact tails being configured to be mounted to a circuit board, the contacts having mating sections extending from the posts, the mating sections being configured for mating with a mating connector, the contacts defining signal contacts and ground contacts with the signal contacts arranged in pairs, the pairs of signal contacts being separated by at least one ground contact; and a housing holding the signal and ground contacts in parallel at a predetermined pitch, the housing having a front and a rear with a cavity at the front being configured to receive the mating connector, the housing having walls defining signal channels that receive the signal contacts and ground channels that receive the ground contacts, the signal channels having a greater volume than the ground channels;

wherein the walls are thicker between the signal contacts and adjacent ground contacts, and wherein the walls are thinner between the adjacent signal contacts within the pair.

15. The receptacle connector of claim 14, wherein the channels have wall surfaces, the wall surfaces of the signal channels being spaced apart by a first average distance, the wall surfaces of the ground channels being spaced apart by a second average distance, the first average distance being greater than the second average distance.

16. The receptacle connector of claim 14, wherein the signal and ground channels have wall surfaces, the signal contacts having opposed sides, the ground contacts having opposed sides, the signal contacts being loaded into the signal channels such that the sides face the wall surfaces of the signal channels, the ground contacts being loaded into the ground channels such that the sides face the wall surfaces of the ground channels, the sides of the ground contacts being spaced apart from the corresponding wall surfaces by substantially equal distances, the sides of the signal contacts being spaced apart from the corresponding wall surfaces by different distances.

17. The receptacle connector of claim 14, wherein the signal and ground channels have wall surfaces, the signal contacts having opposed sides, the ground contacts having opposed sides, the signal contacts being loaded into the signal channels such that the sides face the wall surfaces of the signal channels, the ground contacts being loaded into the ground channels such that the sides face the wall surfaces of the ground channels, the sides of the ground contacts being spaced apart from the corresponding wall surfaces by substantially equal distances, the side of each signal contact facing the adjacent ground contact being spaced apart from the corresponding wall surface by a first distance, the side of each signal contact facing the adjacent signal contact being spaced apart from the corresponding wall surface by a second distance greater than the first distance.

18. The receptacle connector of claim 14, wherein the signal and ground contacts are stitched into the housing.

19. The receptacle connector of claim 14, wherein the signal and ground contacts define upper contacts with the mating sections being arranged along an upper wall of the housing, the receptacle connector further comprising lower contacts being arranged along a lower wall of the housing, the upper contacts being loaded into the housing through the rear of the housing, the lower contacts being loaded into the housing through the front of the housing.

* * * * *